313-422 SR
4/20/82 XR 4,325,489

United States Patent [19]
Russell et al.
[11] 4,325,489
[45] Apr. 20, 1982

[54] ENVELOPE FOR FLAT PANEL DISPLAY DEVICES

[75] Inventors: John P. Russell, Pennington; Charles B. Carroll, Trenton, both of N.J.

[73] Assignee: RCA Corporation, New York, N.Y.

[21] Appl. No.: 140,962

[22] Filed: Apr. 17, 1980

[51] Int. Cl.³ ..... H01K 1/36; H01J 29/86
[52] U.S. Cl. ..... 220/2.2; 174/50.63; 220/2.3 R; 313/422
[58] Field of Search ..... 313/317, 324, 422, 477 R, 313/493, 512; 29/25.1, 25.11, 25.13; 174/17.05, 50.61, 50.63; 220/2.2, 2.3 A

[56] References Cited

U.S. PATENT DOCUMENTS 2,577,239 12/1951 Eitel et al. ..... 220/2.2 X
2,635,205 4/1953 Olson ..... 313/477 X
2,920,785 1/1960 Veres .
2,968,741 1/1961 Frazier .
3,124,714 3/1964 Bendorf ..... 174/50.63 X
3,171,771 3/1965 Badger et al. .
3,368,023 2/1968 Dimock, Jr. ..... 174/50.63 X
3,482,726 12/1969 Schroeder, Jr. ..... 220/2.3 A
4,145,633 3/1979 Peters et al. ..... 313/422

*Primary Examiner*—Paul L. Gensler
*Attorney, Agent, or Firm*—Eugene M. Whitacre; Glenn H. Bruestle; Lester L. Hallacher

[57] ABSTRACT

An envelope for a flat panel display device is comprised of two portions which respectively include a baseplate and a faceplate held in a spaced parallel relationship by a plurality of side walls. A plurality of support walls supports the envelope against collapse from atmospheric pressure. Differences in the heights of the side walls and support walls are compensated for by a flexible seal which extends around the periphery of the envelope so that the faceplate and baseplate and side walls are coupled through the flexible seal.

12 Claims, 3 Drawing Figures

ENVELOPE FOR FLAT PANEL DISPLAY DEVICES

BACKGROUND OF THE INVENTION

This invention relates generally to flat panel display devices and particularly to an evacuatable envelope for such a device.

U.S. Pat. No. 4,145,633 discloses a flat panel display device in which the envelope includes a faceplate and a baseplate held in spaced parallel relationship by sidewalls. A plurality of support walls divide the envelope into a plurality of channels and support the faceplate and baseplate against collapse from atmospheric pressure. The faceplate supports a display screen which gives a visual output when struck by electrons. When a color display is desired shadow mask sections are arranged along the faceplate. The baseplate supports beam guide assemblies and other components required from the production of the visual display.

The display device is a cathode luminescent display and thus must be evacuated for proper operation. The sidewalls, therefore, must be permanently and hermetically affixed to the faceplate and baseplate. Typically, the faceplate, baseplate and sidewalls are made of glass and thus the hermetic seal is accomplished by fritting the sidewalls to the faceplate and baseplate. The frit seals are permanent and, therefore, the internal components must be present in the envelope during the fritting, resulting in several severe problems. High temperature and exposure to air of the internal components are required for the fritting. The beam guide meshes and shadow mask sections typically are thin metallic members and, therefore, corrode and frequently warp resulting in a high rejection rate. Additionally, upon evacuation the envelope is subjected to a high deformation force by atmospheric pressure. Because the faceplate must be made of glass and the baseplate and sidewalls typically are made of glass, the deformation must be minimal in order to prevent cracking. The support walls and sidewalls, therefore, must be dimensioned to tolerances within the permissible deformation of the faceplate and baseplate. The support and sidewalls can be made to the required tolerance by expensive existing techniques, but difficulties nevertheless arise. The frit cycle changes the dimensions of the sidewalls in an unpredictable manner so that even though the required tolerances are maintained while making the sidewalls and support walls, the fritting frequently causes the sidewalls to fall outside of the permissibly tolerances. Accordingly, when an assembled envelope is evacuated, this unpredictable difference can cause either the baseplate or the faceplate to crack.

The instant invention is directed toward an envelope for a flat panel display device which overcomes these difficulties.

SUMMARY OF THE INVENTION

An envelope for a flat panel display device includes a baseplate and a faceplate held in a substantially parallel relationship by a plurality of sidewalls having a first predetermined dimension. A plurality of support walls having a second predetermined dimension extend between the baseplate and the faceplate to divide the envelope into a plurality of channels and to support the envelope against atmospheric pressure. A flexible seal for coupling the baseplate, the faceplate and the sidewalls includes continuous members configured to extend around the periphery of the envelope. The continuous members are dimensioned to extend outwardly past the outside of the sidewalls to form two sealable edges which meet along a hermetically sealable seam to form a space between the continuous members. The space varies in accordance with the difference between the predetermined dimensions of the sidewalls and support walls to compensate for such difference.

DETAILED DESCRIPTION OF THE PREFERRED EMBODIMENT

Figure 1:
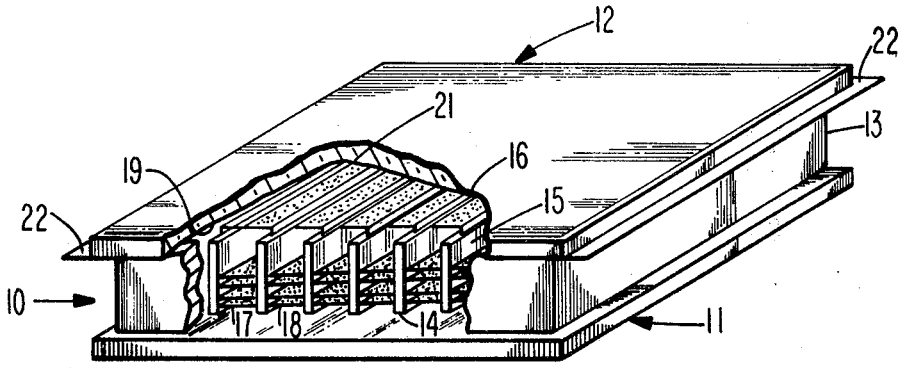
FIG. 1 is a simplified perspective view, partially broken away, of a flat panel display device incorporating the instant invention.

FIG. 1 shows an evacuatable envelope 10 including a baseplate 11 and a faceplate 12 held in a spaced parallel relationship by a plurality of sidewalls 13 extending around the periphery thereof. A plurality of vanes 14 and vane tips 16 combine to form support walls 15 to support the baseplate 11 and faceplate 12 against atmospheric pressure and to divide the envelope 10 into a plurality of longitudinally extending channels 17. Each of the channels 17 including a beam guide assembly 18 along which electron beams propagate. When a line of the visual display is to be printed the electron beams are extracted from the beam guide assemblies 18 of all the channels 17. Accordingly, each of the channels 17 contributes to each line of the display across the transverse dimension of the envelope.

The envelope 10 must be evacuated and, therefore, the sidewalls 13 must be hermetically sealed to the baseplate 11 and faceplate 12. Additionally, the support walls 15 support the baseplate 11 and the faceplate 12 against collapse from the force of atmospheric pressure when the envelope 10 is evacuated. The faceplate, and typically the baseplate, is made of glass and thus the allowable deformation in response to atmospheric pressure is limited. For this reason the sidewalls 13, and the support walls 15 must be made to tolerances within the deformation limits of the faceplate. This is possible on a piece-by-piece basis, using modern techniques. However, several severe disadvantages arise. First, the sidewalls, vanes and vane tips must be tailor made for a specific envelope to assure that dimensional variations are within the permissible tolerances, and, therefore mass production and automatic assembly techniques cannot be economically used. That is, a large number of each of these elements cannot be separately made by mass production techniques and randomly taken from a storage area to assemble an envelope. A very severe problem arises even when the various elements are tailor made for a specific envelope. When the sidewalls are fritted to the baseplate (or faceplate) unpredictable variations arise because the frit build up beneath the sidewalls cannot be precisely controlled. The allowable dimensional variation can thus be exceeded even when all elements are carefully made for a specific envelope. These difficulties are overcome by the use of a novel flexible seal 22, including a space S which accommodates for dimensional differences between the sidewalls and support walls.

FIG. 1 shows the flexible seal 22 arranged along the faceplate 12. If desired, the flexible seal 22 can be arranged along the baseplate 11. Alternatively, the sidewalls 13 can be made in two parts, one part being fixed to the baseplate, the other part to the faceplate and the flexible seal 22 arranged between the two parts. Thus, the envelope 10 is composed of two portions, the baseplate being included in the first portion and the faceplate being included in the second portion. In some instances the sidewalls are fixed to the baseplate and are included in the first envelope portion. In other instances the sidewalls are fixed to the faceplate and are included in the second envelope portion. In the instances in which the sidewalls are made in two parts and affixed to both the baseplate and faceplate, they are included in both envelope portions. Also, a flexible seal can be used to couple the baseplate 11 and the faceplate 12. Irrespective of the location, the flexible seal 22 is arranged to provide a space around the entire periphery of the envelope 10 to flexibly and hermetically couple the two portions of the envelope.

Figure 2:
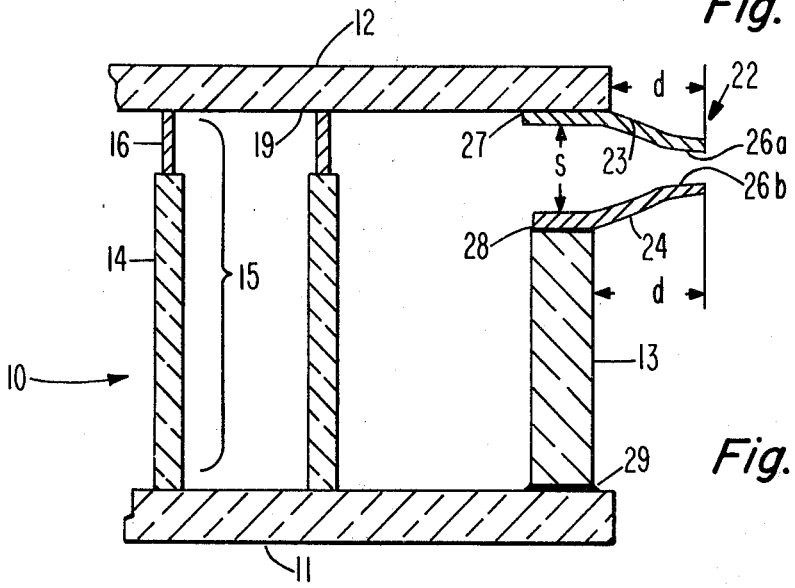
FIG. 2 is an enlarged cross section of a preferred embodiment showing details of the novel structure.

As shown in FIG. 2 the flexible seal 22 includes a continuous member 23, which is configured the same as the periphery of the faceplate 12. The flexible member 23 extends outwardly past the outside of the sidewall 13 by the distance d to form a sealable edge surface 26*a*. The continuous member 23 is fritted, or otherwise permanently affixed, to the inside surface of faceplate 12, as indicated by the joint 27. A second continuous member 24 also is configured similarly to the periphery of the faceplate 12 and extends outwardly past the outside of the sidewall 13, also by the distance d, to form a second sealable edge surface 26*b*. The member 24 is fritted, or otherwise permanently affixed, to the side wall 13 as indicated by the joint 28. The side wall 13 is fritted, or otherwise permanently affixed, to the baseplate 11 as indicated by the joint 29.

In FIG. 2 the height of the support walls 15 is greater than the height of the side wall 13. The flexible members 23 and 24, therefore, are separated by a space S. Because the continuous members 23 and 24 are flexible the space can vary to compensate for substantial dimensional differences between the height of the side walls 13 and the support walls 15. Therefore, when two envelope portions are to be joined, the vane tips 16 are centered on the vanes 14 and the two sealable edge surfaces 26*a* and 26*b* meet along a seam. This seam can be welded by electron beam welding, ultrasonic welding or any other type of welding which does not raise the temperature of the envelope to a level which will permanently harm the guide meshes and shadow mask sections contained within the envelope. After the seam is welded and the envelope evacuated, the space S changes as the flexible members 23 and 24 flex to compensate for the dimensional difference of the side walls and support walls without deforming either the faceplate or the baseplate. When the envelope is evacuated atmospheric pressure collapses the flexible seal 22 and could push the seal 22 into the envelope. This is prevented by the dimension d of the seal extension past the sidewalls. The dimension d is substantially greater than the spacing S and preferably is at least ten times such spacing. Typically, after the envelope is evacuated, S will be approximately 0.030 inches (0.075 cm) and the dimension d will be approximately 2.0 to 3.0 inches (5.0 to 7.5 cm). The distance between the side wall 13 and the first support wall 15 is selected to prevent cracking of the faceplate 12 due to the cantilever effect of atmospheric pressure on the faceplate.

Typically, in order to assure a uniform height for all of the vanes 14 used in one envelope the vanes will be made in sets. The required number of vanes are stacked together and simultaneously machined on both edges. In this manner, the sets of vanes for different envelopes can be different but all of the vanes for a particular envelope will be the same even although mass production techniques are used. The vane tips 16 and side walls also can be stacked, simultaneously machined and stored as sets. The use of the flexible seal 22, therefore, permits the use of automatic assembly and mass production techniques, while substantially reducing failures caused by atmospheric pressure on the faceplate.

After the faceplate and baseplate are joined and the flexible seal 22 is hermetically sealed, the envelope is evacuated and atmospheric pressure attempts to collapse the envelope thereby compressing the vanes and vane tips to permanently retain the support walls 15 between the faceplate and baseplate.

The utilization of an envelope including a flexible seal enjoys several advantages. The dimensions of the support walls and side walls can be different as described above. Additionally, the faceplate 12, the side walls 13 and the baseplate 11 can be made from different materials. In this instance the continuous seal member 23, which is affixed to the faceplate is made of a material which has a coefficient of expansion close to that of the faceplate 12. The seal member 24, which is affixed to the side walls 13, is made of a material which has a coefficient of expansion close to the side walls. This minimizes stress in the frits. The coefficients of expansion of the seal members 23 and 24, therefore, are different. This is permissible because the seal members 23 and 24 are flexible and deform without rupturing the weld along the seam 26.

Another advantage is the ability to repair defects within the envelope. Thus, if after final assembly the required operational characteristics are not within the permissible tolerances, the seal 22 can be opened, the required adjustments made, and the seal reclosed.

Figure 3:
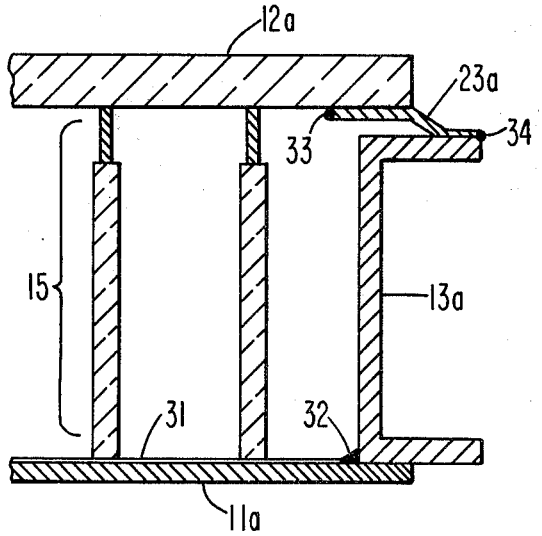
FIG. 3 is a preferred embodiment having metal sidewalls and baseplate.

FIG. 3 shows a preferred embodiment in which the flexible seal consists of a single continuous member 23*a*. The faceplate 12 is identical to that of the previously described embodiment and the continuous member 23*a* is permanently affixed thereto. The side wall 13*a* is made of metal, such as cold rolled or stainless steel, and is channel shaped to provide strength against atmospheric pressure. The baseplate 11*a* also is made of metal, such as cold rolled or stainless steel, and the inside surface has a coating 31 of an insulative material, such as porcelain, to provide the required insulation. The support walls 15 are identical to those of the previously described embodiment. The side wall 13*a* is hermetically attached to the baseplate 11*a* by a weld 32.

The faceplate 12*a* and seal member 23*a* are respectively made of glass and metal and are hermetically attached by a glass to metal seal 33. The sealable edge surface which is equivalent to the edge surface 26*b* in FIG. 2 is integral with the side wall 13*a* and the two edges are hermetically sealed by a weld 34. Large stresses in the seal 33 are avoided by selecting materials for the faceplate 12*a* and seal member 23*a* which have close, but not necessarily equal, coefficients of expansion. For this reason the seal member 23*a* will typically have a coefficient of expansion which is substantially different from that of side walls 13*a*. The integrity of the weld 34 is not adversely affected because the seal member 23*a* is thin and flexible and, therefore, deforms without the weld 34 parting.

The FIG. 3 embodiment is advantageous because fixturing techniques, which greatly reduce vacuum induced deformation stresses in the welds, can be used. The side walls 13 can be deformed by a fixture to the approximate vacuum loaded position before the welds 32 and 34 are made. The fixture is removed after envelope evacuation and prior to envelope bakeout. The welds are, therefore, made subsequent to the deformation of the welded parts and thus are not stressed by such deformation.

Another advantage of the FIG. 3 embodiment is the ability to add internal components to the faceplate and baseplate before the side walls are present. This makes it simplier to apply the phosphors to the faceplate and the electrodes to the baseplate and is permissible because the welding of welds 32 and 33 does not require high temperatures. The FIG. 3 embodiment is also advantageous because the porcelain covered baseplate 11*a* can be treated as a large printed circuit. Accordingly, connection of internal circuitry to circuitry outside the envelope can be made using plated through-holes and other well known printed circuit techniques.

What is claimed is:

1. An envelope for a flat panel display device comprising:

a first envelope portion including a baseplate and a second envelope portion including a faceplate said baseplate and said faceplate being arranged in a spaced substantially parallel relationship;

a plurality of side walls included in at least one of said envelope portions and extending between said baseplate and said faceplate around the periphery of said envelope to maintain said substantially parallel relationship, said side walls having a first predetermined dimension;

a plurality of support walls extending between said baseplate and said faceplate to divide said envelope into a plurality of channels and to support said baseplate and said faceplate against atmospheric pressure, said support walls having a second predetermined dimension greater than said first predetermined dimension, a flexible seal for hermetically and flexibly coupling said envelope portions, said seal including a first continuous member affixed to said first portion and configured to extend around the periphery of said envelope and dimensioned to extend outwardly past the outside of said side walls to form a first sealable edge surface, a second continuous member affixed to said second portion and configured to extend around the periphery of said envelope and dimensioned to extend outwardly past the outside of said side walls to form a first sealable edge surface, a second continuous member affixed to said second portion and configured to extend around the periphery of said envelope and dimensioned to extend outwardly past the outside of said side walls to form a second sealable edge surface, said edge surfaces meeting along a sealable seam to form a space between said continuous members, said space varying in accordance with any difference between said first and second predetermined dimensions as said seal flexes in response to atmospheric pressure compressing said support walls between said baseplate and said faceplate.

2. The envelope of claim 1 wherein said first and second continuous members are made from flexible metal.

3. The envelope of claim 2 wherein said envelope portions have different coefficients of expansion and said first continuous member has a coefficient of expansion near that of said first portion and said second continuous member has a coefficient of expansion near that of said second portion.

4. The envelope of claim 2 wherein the outwardly extending dimension of said continuous members is at least ten times greater than said space.

5. The envelope of claim 2 wherein each of said side walls is composed of two parts, one of said parts being included in said first envelope portion and the other of said parts being included in said second envelope portion.

6. The envelope of claim 2 wherein said side walls are included in said first envelope so that said space is arranged along said faceplate.

7. An envelope for a flat panel display device comprising;

a baseplate and a faceplate arranged in a spaced substantially parallel relationship;

a plurality of side walls extending between said baseplate and said faceplate around the periphery of said envelope, to maintain said substantially parallel relationship, said side walls having a first predetermined dimension;

a plurality of support walls extending between said baseplate and said faceplate to divide said envelope into a plurality of channels and to support said baseplate and said faceplate against atmospheric pressure, said support walls having a second predetermined dimension greater than said first predetermined dimension, a flexible seal for hermetically and flexibly coupling said baseplate, said faceplate and said side walls, said seal including at least one continuous member configured to extend around the periphery of said envelope to form a first sealable edge surface, means for forming a second sealable edge surface configured substantially identically to said first sealable edge surface, said edge surfaces meeting along a sealable seam to form a space, said space varying in accordance with any difference between said first and second predetermined dimensions to compensate for said difference so that said flexible seal couples said baseplate, said faceplate and said side walls to retain said support walls between said baseplate portion and said faceplate portion when said envelope is evacuated.

8. The envelope of claim 7 wherein said means for forming a second sealable edge surface is integral with said side wall.

9. The envelope of claim 8 wherein said continuous member is affixed to one of said plates and has a coefficient to expansion close to that of said plate.

10. The envelope of claim 8 wherein said continuous member is affixed to said faceplate and wherein said side walls and said baseplate are made of metal.

11. The envelope of claim 10 wherein said continuous member has a coefficient of expansion close to that of said faceplate.

12. The envelope of claim 11 wherein said side walls and said baseplate are deformed prior to affixing said side walls to said baseplate to minimize deformation stresses caused by evacuation of said envelope.

* * * * *

UNITED STATES PATENT AND TRADEMARK OFFICE

CERTIFICATE OF CORRECTION

PATENT NO. : 4,325,489

DATED : April 20, 1982

INVENTOR(S) : John P. Russell and Charles B. Carroll

It is certified that error appears in the above—identified patent and that said Letters Patent is hereby corrected as shown below:

Column 5, Claim 1, lines 56 to 60, delete --to form a first sealable edge surface, a second continuous member affixed to said second portion and configured to extend around the periphery of said envelope and dimensioned to extend outwardly past the outside of said side walls--.

Signed and Sealed this

*Twenty-second* Day of *June 1982*

[SEAL]

*Attest:*

GERALD J. MOSSINGHOFF

*Attesting Officer*

*Commissioner of Patents and Trademarks*